US006672855B2

(12) United States Patent
North

(10) Patent No.: US 6,672,855 B2
(45) Date of Patent: Jan. 6, 2004

(54) VACUUM PUMPS

(75) Inventor: Michael Henry North, Reigate (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 09/740,085

(22) Filed: Dec. 19, 2000

(65) Prior Publication Data

US 2001/0024620 A1 Sep. 27, 2001

(30) Foreign Application Priority Data

Dec. 23, 1999 (GB) ..... 9930556

(51) Int. Cl.[7] ..... F04C 18/00
(52) U.S. Cl. ..... 418/194; 418/9
(58) Field of Search ..... 418/194, 9

(56) References Cited

U.S. PATENT DOCUMENTS

| | | | | | |
|---|---|---|---|---|---|
| 1,164,546 | A | * | 12/1915 | Neuland | 418/194 |
| 2,543,894 | A | * | 3/1951 | Colombo | 425/204 |
| 4,684,335 | A | | 8/1987 | Goodridge | 418/189 |
| 4,792,294 | A | * | 12/1988 | Mowli | 418/9 |
| 5,667,370 | A | * | 9/1997 | Im | 418/9 |
| 6,129,534 | A | * | 10/2000 | Schofield et al. | 418/194 |
| 6,176,694 | B1 | * | 1/2001 | Fang et al. | 418/194 |
| 6,257,839 | B1 | * | 7/2001 | Fang et al. | 418/194 |

FOREIGN PATENT DOCUMENTS

| | | | | |
|---|---|---|---|---|
| DE | 197 28 434 A1 | | 7/1997 | F04C/18/16 |
| DE | 197 36 017 A1 | | 8/1997 | F04C/23/02 |
| DE | 197 45 615 A1 | | 10/1997 | F04C/25/00 |
| DE | 198 00 711 A1 | | 1/1998 | F04C/18/16 |
| DE | 198 00 825 A1 | | 2/1998 | F04C/18/16 |
| FR | 789211 | * | 8/1935 | 418/194 |
| GB | 419338 | | 1/1934 | 236/34 |
| GB | 981482 | * | 1/1965 | 418/194 |

* cited by examiner

*Primary Examiner*—Thomas Denion
*Assistant Examiner*—Theresa Trieu
(74) *Attorney, Agent, or Firm*—Ira Lee Zebrak

(57) ABSTRACT

A vacuum pump having a screw mechanism and comprising two externally threaded rotors mounted on respective shafts in a pump body and adapted for counter-rotation therein with intermeshing of the rotor threads with close tolerances between the threads and internal surfaces of the pump body in order that gas may be pumped from a pump inlet to a pump outlet by action of the rotor threads, the root diameter of each rotor increases and the thread diameter of each rotor decreases in a direction from the pump inlet to the pump outlet, and wherein the pitch of the rotor threads decreases in a direction from the pump inlet to the pump outlet.

8 Claims, 2 Drawing Sheets

VACUUM PUMPS

FIELD OF THE INVENTION

Figure 1:
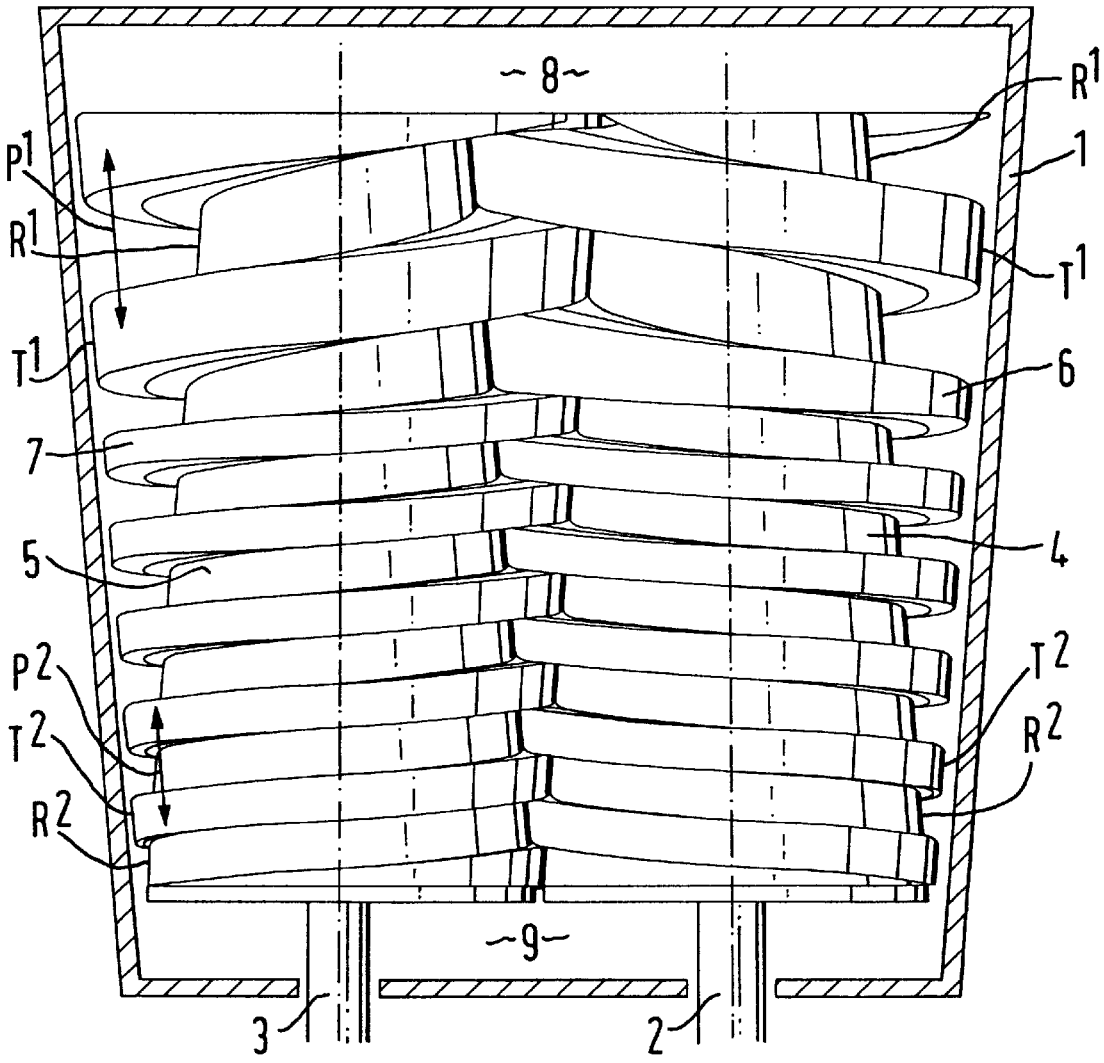

This invention relates to oil free (dry) vacuum pumps operating with a screw mechanism and, more particularly, to such vacuum pumps having improved pumping speeds, especially at low inlet pressures.

BACKGROUND OF THE INVENTION

A screw mechanism vacuum pump comprising two externally threaded or vaned rotors mounted in a pump body and adapted for counter-rotation in the body with intermeshing of the rotor threads is well known. Close tolerances between the rotor threads at the points of intermeshing and with the internal surfaces of the pump body causes volumes of gas being pumped between an inlet and an outlet to be trapped between the threads of the rotors and the internal surface of the pump body and thereby urged through the pump as the rotors rotate.

Such screw pumps are potentially attractive because they can be manufactured with few working components and they have an ability to pump from a high vacuum environment at the pump inlet down to atmospheric pressure at the pump outlet.

Screw pumps are generally designed with each screw rotor being of generally cylindrical form overall, with the screw thread tip cross-section being substantially constant along the length of the rotor. This has a disadvantage in vacuum pumps in particular that no volumetric compression is generated in use of the pump along the length of the rotor, thereby detrimentally affecting the pump's power consumption.

A further disadvantage commonly encountered with screw pumps is that they can suffer from low pumping speeds at relatively low inlet pressures, for example of the order of 50 mbar or less.

One way of minimising such disadvantages is described in our earlier European Patent Application No. 99304669.7 and U.S. patent application Ser. No. 09/334,316 in which vacuum pumps are described having intermeshing screw rotors whose cross-sections taper such that a volumetric compression is generated along the length of the screw mechanism in a direction from pump inlet to pump outlet.

This taper is achieved by having a gradually increasing root diameter of each rotor and a gradually decreasing thread diameter of each rotor, both in a direction from the pump inlet to the pump outlet. The purpose of the volumetric compression is gradually to reduce the volume available between the rotors as the volumes of gas pass through the pump and, in particular, to minimise the size of the exhaust stage, thereby keeping the power consumption of the pump to a minimum whilst maintaining a relatively large pump inlet size so as to allow faster evacuation of the chamber being pumped and faster pump inlet speeds of the gas being pumped.

However, there are practical restraints on the degree of compression possible in the tapered screw mechanism. Generally, a maximum achievable volume ratio is about 4:1, i.e. the initial trapped volume of gas at the inlet end of the pump can be compressed only to about 25% of the initial volume at the exhaust end of the pump.

SUMMARY OF THE INVENTION

In accordance with the invention of our earlier applications, a separate Roots mechanism stage is employed at the inlet end of the pump in order to improve the overall performance of the pump in general and the inlet speed of the gas being pumped in particular.

Nevertheless, the presence of a separate Roots mechanism stage has the disadvantages that it increases the size, complexity and cost of the vacuum pump.

The present invention is concerned with the provision of a vacuum pump which overcomes these disadvantages.

In accordance with the invention, there is provided a vacuum pump having a screw mechanism and comprising two externally threaded rotors mounted on respective shafts in a pump body and adapted for counter-rotation therein with intermeshing of the rotor threads with close tolerances between the threads and internal surfaces of the pump body in order that gas may be pumped from a pump inlet to a pump outlet by action of the rotor threads, the root diameter of each rotor increases and the thread diameter of each rotor decreases in a direction from the pump inlet to the pump outlet, and wherein the pitch of the rotor threads decreases in a direction from the pump inlet to the pump outlet.

The decrease in pitch of the rotor threads generally allows for the pump to achieve a greater volume ratio and hence a greater compression of the gas being pumped as it passes through the pump from its inlet to its outlet.

The decrease in pitch 2 may be effected gradually from each thread turn to the next one along the length of each rotor, for example with a uniform or linear change in pitch between adjacent thread turns or, alternatively, with a non-linear increase being, for example, one which is proportional to the square of the distance to the base of the screw thread. The pitch of the first turn is advantageously up to about three times that of the final turn, for example, two times that of the final turn.

In alternative embodiments, the decrease in pitch may be non-gradual to suit the requirements of pump performance or ease of manufacture. In particular, an initial number of turns of each rotor thread, for example one to three turns, may have the same pitch and a subsequent number, or the remainder, of turns have a decreased pitch. In such embodiments, the pitch of the initial turns may usefully be up to three times that of the subsequent turns, for example about two times that of the subsequent turns.

It has been found that a volume ratio of up to 10:1 or more can be achieved. A volume ratio of from 4:1 to 6:1 is preferred, for example 4:1 or 5:1.

The variation in pitch in accordance with the invention generally allows the inlet section of the screw mechanism to have a higher swept volume than with known mechanisms and enable the pumping speed to be improved.

Pumps of the invention can generally be operated across the range of normal pump inlet pressures and gas delivered at the pump exhaust at atmospheric pressure.

Typical inlet pressures of 50 mbar or less allows the pumps to be operated at full rotor speeds, normally of the order of ten thousand revolutions per minute (rpm). However, at inlet pressures approaching or at atmospheric pressures encountered, for example, at pump start up, there may be too many compressive forces across the screw mechanism occasioning high power consumption. In preferred embodiments, pumps of the invention employ an electronic device mechanism which limits the torque delivered by the pump motor to a level which can be sustained at the prevailing inlet pressure. This is achieved by reducing the shaft speed.

BRIEF DESCRIPTION OF THE INVENTION

Figure 2:
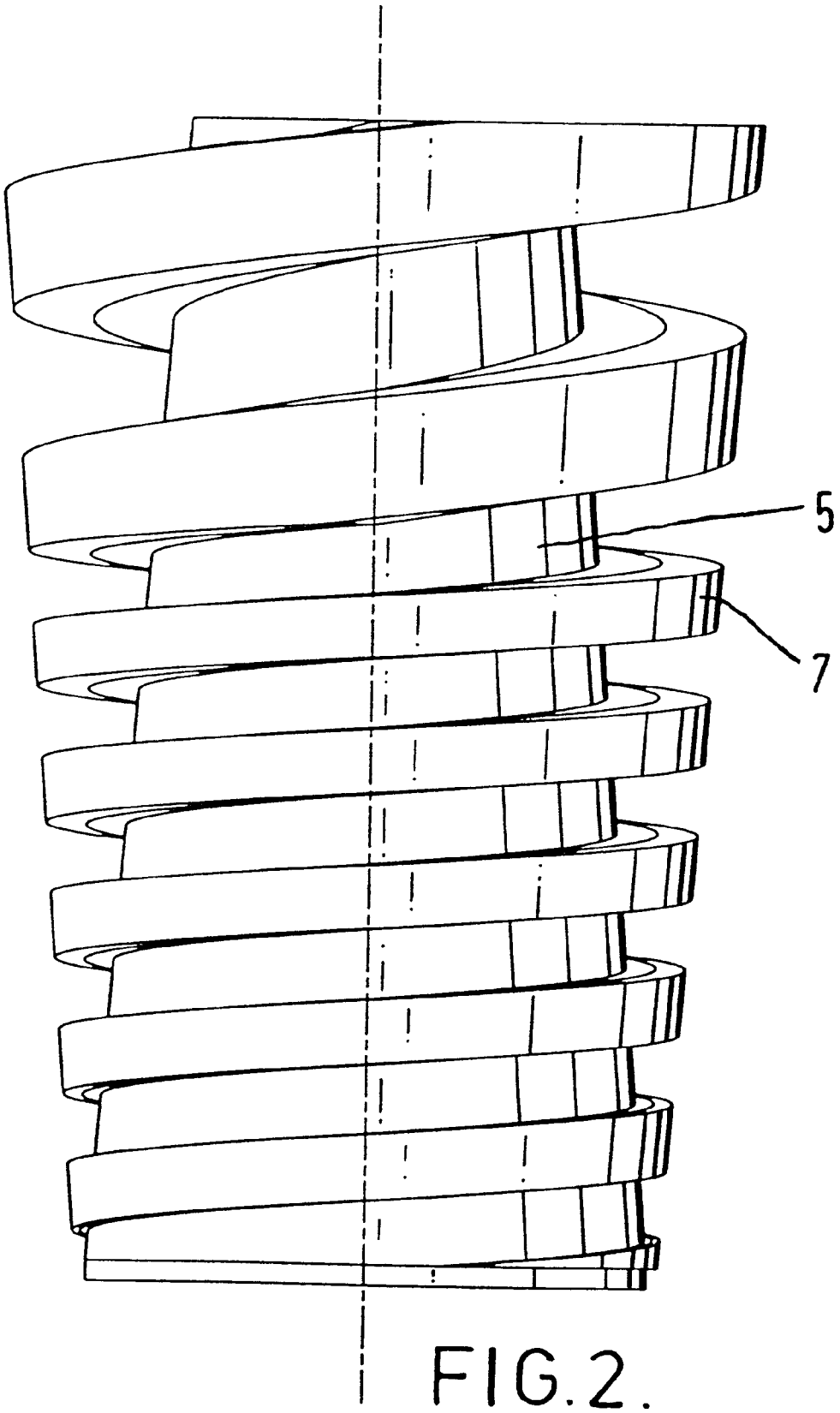

For a better understanding of the invention, reference will now be made, by way of exemplification only, to the accompanying drawings, of which:

FIG. 1 shows a schematic representation of the screw rotors of a vacuum pump of the invention; and FIG. 2 shows one of the rotors of FIG. 1 in a clearer form.

DETAILED DESCRIPTION OF THE INVENTION

With reference to the drawings, there is shown in FIG. 1 a schematic representation of a vacuum pump of the invention with particular reference to the screw rotors therein. The vacuum pump comprises a pump body 1 within which are mounted by bearing means (not shown) a first shaft 2 and a second shaft 3 spaced from and parallel to the first shaft 2.

Mounted on the shafts 2, 3 are respective rotors 4, 5 each having an external thread 6, 7 on its outer surface.

The shafts 2, 3 and hence the rotors 4, 5 are adapted for rotation about their longitudinal axes with one shaft being driven by a motor and associated torque limiting electronic drive (all not shown) and the other shaft being linked to the first shaft by timing gears such that the driven shaft rotates at a rotational speed of about ten thousand revolutions per minute (rpm) and the other shaft rotates at the same speed but in the opposite direction.

The position and size of the shafts 2, 3 and rotors 4, 5 in relation to each other and to the internal surfaces of the body 1 are such that the threads 6, 7 intermesh as the shafts rotate with a close clearance tolerance between the threads and with the internal body surfaces.

A pump inlet 8 is present in the top (as shown) of the body 1 and a pump outlet 9 is present in the bottom (as shown) of the body 1.

In accordance with the invention:

i) the root diameter of each rotor increases between the points $R^1$ and $R^2$ in a direction from the pump inlet 8 to the pump outlet 9, ii) the thread diameter of each rotor decreases between the points $T^1$ and $T^2$ in a direction from the pump inlet 8 to the pump outlet 9, and iii) the pitch of the rotor threads of each rotor decreases in a direction from the pump inlet to the pump outlet.

In the embodiment shown in FIG. 1, the pitch $P^1$ of the thread turn nearest the pump inlet 8 is larger than the pitch $P^2$ of the thread turn nearest the pump outlet 9 in accordance with point iii) above.

As shown, the pitch of the first two turns nearest the pump inlet 8 is constant and that of the subsequent turns towards the pump outlet 9 is constant but smaller—by a factor of two—than that of the first two turns. The rotor 5 is shown more clearly in FIG. 2 in isolation from the rotor 4.

In use of the pump shown in the drawings, the motor drives the shafts and their respective rotors in opposite directions at high speed and gas is drawn in to the pump from a chamber to be evacuated and connected to the pump inlet 8. As the gas passes through the pump in discrete volumes formed between the opposite individual turns of the rotors with the gas being compressed as it passes from one volume to the next by virtue of the tapered rotor thread diameter and the decreasing pitch of the rotor threads.

In the example shown, the volumetric compression is of the order of a 10:1 volume ratio.

I claim:

1. A vacuum pump having a screw mechanism and comprising two externally threaded rotors each one comprising one piece and mounted on respective shafts in a pump body and adapted for counter-rotation therein with intermeshing of the rotor threads with close tolerances between the threads and internal surfaces of the pump body in order that gas may be pumped from a pump inlet to a pump outlet by action of the rotor threads, the root diameter of each rotor increases and the thread diameter of each rotor decreases in a direction from the pump inlet to the pump outlet, and wherein a first one of the rotors has a first set of threads having a constant pitch and a second set of threads with a varying pitch less than the constant pitch.

2. The pump according to claim 1 in which the varying pitch of the second set of threads gradually decreases from each thread turn to the next one along each rotor in a direction from the pump inlet to the pump outlet.

3. The pump according to claim 2 in which the decrease is formed with a uniform change in pitch between adjacent thread turns.

4. The pump according to claim 2 in which the decrease is formed with a non-uniform change in pitch between adjacent thread turns.

5. The pump according to claim 4 in which the decrease in pitch is non-gradual.

6. The pump according to claim 5 in which there is an initial number of turns of each rotor thread having the same pitch and a subsequent number of turns have a decreased pitch.

7. The pump according to claim 1 wherein said gas is compressed as it passes from said pump inlet to said pump outlet.

8. The pump according to claim 1 wherein said compression is about 10:1 volume ratio.

* * * * *